US006529090B2

(12) United States Patent
Lam

(10) Patent No.: US 6,529,090 B2
(45) Date of Patent: Mar. 4, 2003

(54) TWO-SIDED PRINTED CIRCUIT ANTI-SYMMETRIC BALUN

(75) Inventor: Tommy Lam, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 20 days.

(21) Appl. No.: 09/854,597

(22) Filed: May 15, 2001

(65) Prior Publication Data

US 2002/0171506 A1 Nov. 21, 2002

(51) Int. Cl.[7] ..... H01P 5/10
(52) U.S. Cl. ..... 333/26; 343/872; 343/859
(58) Field of Search ..... 333/26, 25, 33; 343/859, 872

(56) References Cited

U.S. PATENT DOCUMENTS

| | | | | |
|---|---|---|---|---|
| 3,571,722 A | | 3/1971 | Vendelin | 325/445 |
| 3,846,721 A | | 11/1974 | Fritz et al. | 333/26 |
| 4,193,048 A | | 3/1980 | Nyhus | 333/26 |
| 4,755,775 A | | 7/1988 | Marczewski et al. | 333/26 |
| 4,952,895 A | | 8/1990 | Quan | 333/121 |
| 5,003,622 A | | 3/1991 | Ma et al. | 455/327 |
| 5,061,910 A | | 10/1991 | Bouny | 333/26 |
| 5,172,082 A | * | 12/1992 | Livingston et al. | 333/26 |
| 5,303,419 A | | 4/1994 | Ittipiboon et al. | 455/327 |
| 5,349,365 A | | 9/1994 | Ow et al. | 343/895 |
| 5,357,223 A | | 10/1994 | Forgeot | 333/26 |
| 5,600,286 A | | 2/1997 | Livingston et al. | 333/26 |
| 6,437,757 B1 | * | 8/2002 | Butler | 343/872 |

OTHER PUBLICATIONS

Merriam–Webster's collegiate dictionary.—10$^{th}$ edition, "diametric" p. 319.*

* cited by examiner

*Primary Examiner*—Robert Pascal
*Assistant Examiner*—Dean Takaoka
(74) *Attorney, Agent, or Firm*—Schwartz & Weinrieb

(57) ABSTRACT

A balun component or structural subassembly, for use in conjunction with an antenna radome assembly, comprises a two-sided printed circuit board substrate having a longitudinal axis, wherein each side of the two-sided printed circuit board substrate is asymmetric with respect to itself but is in effect anti-symmetric with respect to the opposite side of the two-sided printed circuit board substrate in a 180° out-of-phase manner such that the entire two-sided printed circuit board balun component or structural subassembly exhibits diametrical symmetry with respect to the longitudinal axis of the overall two-sided printed circuit board substrate. Such diametrical symmetry with respect to the longitudinal axis of the overall two-sided printed circuit board substrate enables operatively associated antenna sensor amplitude and phase comparison assemblies or systems to achieve well-behaved and unsquinted amplitude and phase patterns regardless or independent of polarization in order to reduce angle of arrival (AOA) errors. In addition, the balun component or structural subassembly comprises tapered transformer structure which effectively converts the coaxial feed point impedance values of incoming signals to signals having impedance values at the output or downstream end which are able to achieve good impedance matching with the aforenoted spiral circuit component or assembly of the radome elements or components of the overall antenna structure. Still further, such tapered transformer structure positively affects or enhances the range of bandwidth frequencies over which the balun component or structural subassembly is capable of operating.

20 Claims, 5 Drawing Sheets

TWO-SIDED PRINTED CIRCUIT ANTI-SYMMETRIC BALUN

STATEMENT OF GOVERNMENT INTERESTS

The United States Government has a paid-up license in connection with the present invention and accordingly has the right in limited circumstances to require the patent owner to license others on reasonable terms as provided for by means of the terms of United States Government Contract Number N00019-97-C-0147 which was awarded by means of the United States Navy.

FIELD OF THE INVENTION

The present invention relates generally to balun components or structural subassemblies utilized in conjunction with antenna radome assemblies, and more particularly to a new and improved balun component or structural subassembly which comprises a two-sided printed circuit board substrate having a longitudinal axis, and wherein each side of the two-sided printed circuit board substrate is asymmetric with respect to itself but is in effect anti-symmetric with respect to the opposite side of the two-sided printed circuit board substrate in a 180° out-of-phase manner such that the entire two-sided printed circuit board balun component or structural subassembly exhibits diametrical symmetry with respect to the longitudinal axis of the overall two-sided printed circuit board substrate.

BACKGROUND OF THE INVENTION

Most direction finding systems utilize antenna sensor amplitude and phase comparison techniques in order to necessarily determine angle of arrival (AOA) information or data with respect to a distant emitter. Such antenna sensor amplitude and phase comparison assemblies or systems must exhibit well-behaved amplitude and phase patterns regardless or independent of polarization in order to reduce angle of arrival (AOA) errors. Some prior art balun components, devices, or structural subassemblies have in fact been developed for utilization within such antenna sensor amplitude and phase comparison assemblies or systems in an attempt to provide such well-behaved and unsquinted amplitude and phase patterns, however, their performance has unfortunately been limited to narrow frequency bandwidth parameters. Other prior art balun components or subassemblies comprise broadband devices, however, they require cumbersome coaxial implementation which renders the antenna sensor amplitude and phase comparison assembly or system unnecessarily and undesirably large. Still other prior art balun components or subassemblies are desirably small and light in weight but are not symmetrical and therefore do not provide the required well-behaved and unsquinted amplitude and phase patterns regardless or independent of polarization.

Still further, the balun components or subassemblies are often particularly adapted for cooperative use in conjunction with spiral circuit components or assemblies which are, in turn, operatively associated with radome elements or components of overall antenna radome assemblies. Such balun components or subassemblies conventionally comprise parallel strip transmission lines, however, such parallel strip transmission lines are known to have high impedance values on the order of 200 ohms due to their inherently low capacitance characteristics which renders impedance matching difficult to achieve. As a result, antenna efficiency and operating bandwidth are compromised within the printed circuit board line width and spacing tolerances.

A need therefore exists in the art for a new and improved balun component or structural subassembly which can be utilized within antenna sensor amplitude and phase comparison assemblies or systems wherein such balun component or structural subassemblies can provide well-behaved and unsquinted amplitude and phase patterns regardless or independent of polarization in order to reduce angle of arrival (AOA) errors, and wherein further, such balun components or structural subassemblies will exhibit broad frequency bandwidth parameters as well as good antenna radome assembly impedance matching characteristics.

OBJECTS OF THE INVENTION

Accordingly, it is an object of the present invention to provide a new and improved balun component or structural subassembly for use within antenna sensor amplitude and phase comparison assemblies or systems.

Another object of the present invention is to provide a new and improved balun component or structural subassembly for use within antenna sensor amplitude and phase comparison assemblies or systems which effectively overcome the various operational drawbacks or disadvantages characteristic of PRIOR ART antenna sensor amplitude and phase comparison assemblies or systems.

An additional object of the present invention is to provide a new and improved balun component or structural subassembly for use within antenna sensor amplitude and phase comparison assemblies or systems which can provide well-behaved and unsquinted amplitude and phase patterns regardless or independent of polarization in order to reduce angle of arrival (AOA) errors.

A further object of the present invention is to provide a new and improved balun component or structural subassembly for use within antenna sensor amplitude and phase comparison assemblies or systems which will exhibit broad frequency bandwidth parameters as well as good antenna radome assembly impedance matching characteristics.

SUMMARY OF THE INVENTION

The foregoing and other objectives are achieved in accordance with the teachings and principles of the present invention through the provision of a new and improved balun component or structural subassembly, for use within antenna sensor amplitude and phase comparison assemblies or systems, which comprises a two-sided printed circuit board substrate having a longitudinal axis, and wherein each side of the two-sided printed circuit board substrate is asymmetric with respect to itself but is in effect anti-symmetric with respect to the opposite side of the two-sided printed circuit board substrate in a 180° out-of-phase manner such that the entire two-sided printed circuit board balun component or structural subassembly exhibits diametrical symmetry with respect to the longitudinal axis of the overall two-sided printed circuit board substrate.

As a result of the aforenoted asymmetric, anti-symmetric structural characteristics of the new and improved balun component or structural subassembly, the aforenoted diametrical symmetry with respect to the longitudinal axis of the overall two-sided printed circuit board substrate enables the operatively associated antenna sensor amplitude and phase comparison assemblies or systems to achieve well-behaved and unsquinted amplitude and phase patterns regardless or independent of polarization in order to reduce angle of arrival (AOA) errors. In addition, the anti-symmetric structure of the new and improved balun component or structural subassembly exhibits balanced output characteristics for operative cooperation with spiral circuit components or assemblies of radome elements or components of overall antenna radome assemblies. Still further, the new and improved balun component or structural subassembly lastly comprises tapered transformer structure which effectively converts the coaxial feed point impedance value to an impedance value at the output or downstream end which is able to achieve good impedance matching with the aforenoted spiral circuit component or assembly of the radome elements or components of the overall antenna structure. In addition, such tapered transformer structure positively affects or enhances the range of bandwidth frequencies over which the new and improved balun component or structural subassembly is capable of operating.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
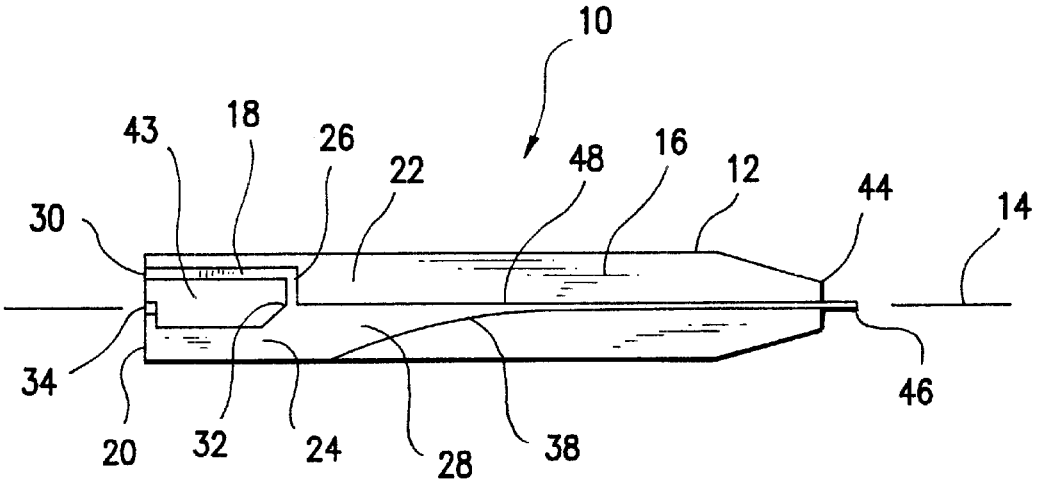
FIG. 1 is a top plan view of a new and improved balun component or structural subassembly constructed in accordance with the principles and teachings of the present invention and showing the cooperative parts thereof.

Referring now to the drawings, and more particularly to FIG. 1 thereof, a new and improved balun component or structural subassembly, constructed in accordance with the principles and teachings of the present invention, is disclosed in a top plan view of the same and is generally indicated by the reference character 10. More particularly, the new and improved balun component or structural subassembly 10 constructed in accordance with the principles and teachings of the present invention is seen to comprise a printed circuit board substrate 12 which has a longitudinal axis 14 and a top or front surface portion 16. A microstrip line 18 extends axially inwardly from a left end edge portion 20 of the printed circuit board substrate 12, and it is seen that the microstrip line 18 is disposed at a radially offset position with respect to the longitudinal axis 14 of the printed circuit board substrate 12 so as to effectively be disposed upon a first lateral upper side portion 22 of the top or front surface portion 16 of the printed circuit board substrate 12 as considered with respect to the longitudinal axis 14. The microstrip line 18 is copper-plated upon the top or front surface portion 16 of the printed circuit board substrate 12 and is integrally connected to a first anti-symmetric ground plane 24 by means of a radially or transversely extending electrical connector portion 26. Both the first anti-symmetric ground plane 24 and the transversely or radially extending electrical connector portion 26 are also copper-plated upon the top or front surface portion 16 of the printed circuit board substrate 12, and it is seen that the first anti-symmetric ground plane 24 is likewise disposed at a radially offset position with respect to the longitudinal axis 14 of the printed circuit board substrate 12 so as to effectively be disposed upon a second lower lateral side portion 28 of the top or front surface portion 16 of the printed circuit board substrate 12 as considered with respect to the longitudinal axis 14.

The extreme left end portion of the microstrip line 18 is operatively connected to a coaxial feed point 30, through which incoming signals are introduced by means of a suitable coaxial connector, not shown, and accordingly, the incoming signals are therefore capable of being conducted or transmitted along the microstrip line 18 and the radially or transversely extending electrical connector portion 26. At the intersection 32 defined between the radially or transversely extending electrical connector portion 26 and the first anti-symmetric ground plane 24, the incoming signal is effectively split into a first portion which is conducted in the leftward direction toward an RF short circuit point 34, comprising a hole electrically connecting the top or upper surface portion 16 of the printed circuit board substrate 12 to a bottom or rear surface portion 36 of the printed circuit board substrate 12, and into a second portion which is conducted in the rightward direction toward a first tapered transformer 38 which is integral with the first anti-symmetric ground plane 24. It is to be noted that as a result of the transmission of the first portion of the signal toward the RF short circuit point 34, that portion of the incoming signal is effectively bounced back or reflected by means of the RF short circuit hole 34 so as to in turn be 180° out of phase with respect to subsequently transmitted first portion signals, thereby effectively cancelling the same. This enables or facilitates enhanced transmission of the second portion signals toward and along the first tapered transformer 38. Such second portions of the incoming signals are thus able to be transformed from signals having an impedance value of 50 ohms to signals having an impedance value of 120 ohms so as to facilitate impedance matching with a spiral circuit component 40 of an antenna radome assembly 42, the structure of which will be discussed in greater detail in connection with FIGS. 4 and 5. It is also noted that an air gap region 43 is defined upon the top or front surface portion 16 of the printed circuit board substrate 12 between the microstrip line 18 and the first anti-symmetric ground plane 24.

It is to be noted that the transformation of the second signal portion being conducted or transmitted along the first tapered transformer 38 occurs as a result of the first tapered transformer 38 having a uniquely curved, arcuate, or tapered configuration, as disclosed within FIG. 1, which extends in the longitudinal axial direction from its integral connection with the first anti-symmetric ground plane 24 toward an opposite end edge portion 44 of the printed circuit board substrate 12. The first tapered transformer 38 terminates in a balun tip antenna connection line or terminal wire 46 which extends a predetermined distance beyond the opposite end edge portion 44 of the printed circuit board substrate 12. It is noted still further that the upper edge portion 48 of the first tapered transformer 38, as disclosed or viewed in FIG. 1, is disposed above the longitudinal axis 14 so as to be effectively disposed upon the first lateral side portion 22 of the top or upper surface portion 16 of the printed circuit board substrate 12.

Figure 2:
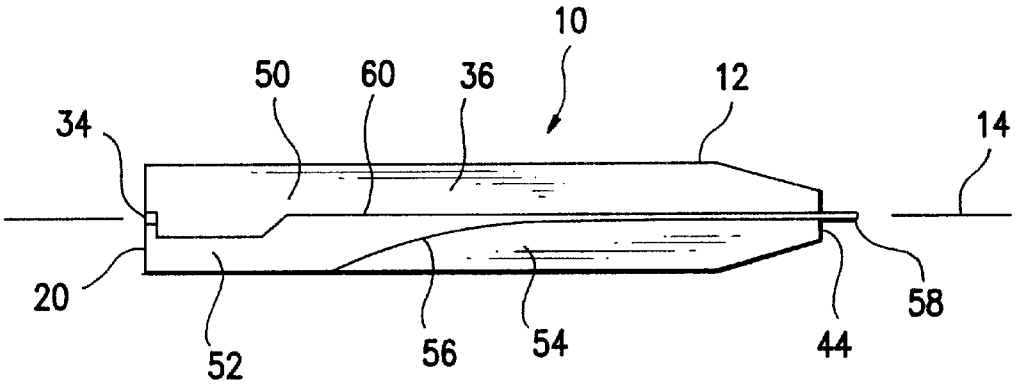
FIG. 2 is a bottom plan view of the new and improved balun component or structural subassembly as shown in FIG. 1, and corresponding to the new and improved balun component or structural subassembly as shown in FIG. 1 when the new and improved balun component or structural subassembly as shown in FIG. 1 is rotated around the longitudinal axis thereof, thereby illustrating the anti-symmetric structure of the new and improved balun component or structural subassembly constructed in accordance with the principles and teachings of the present invention.
Figure 3:
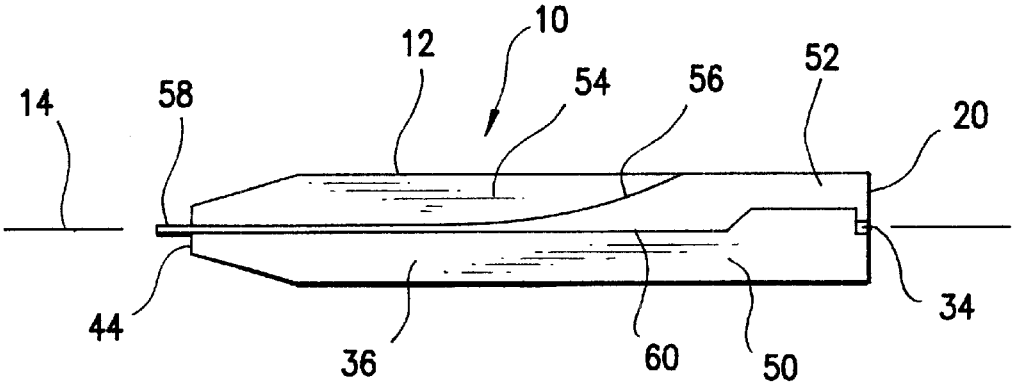
FIG. 3 is a bottom plan view of the new and improved balun component or structural subassembly as shown in FIG. 1, and corresponding to the new and improved balun component or structural subassembly as shown in FIG. 1 when the new and improved balun component or structural subassembly as shown in FIG. 1 is rotated around the left end edge portion thereof, thereby illustrating, from a somewhat different perspective than that of FIG. 2, the anti-symmetric structure of the new and improved balun component or structural subassembly constructed in accordance with the principles and teachings of the present invention.

With reference now being made to FIGS. 2 and 3, there are respectively disclosed bottom plan views of the new and improved balun component or structural subassembly 10 constructed in accordance with the principles and teachings of the present invention and corresponding to the top plan view of the same as disclosed within FIG. 1 but viewed from different perspective viewpoints. More particularly, in accordance with the new and improved balun component or structural subassembly 10 constructed in accordance with the principles and teachings of the present invention, it is seen that the bottom or rear surface portion 36 of the printed circuit board substrate 12 is structured so as to effectively be anti-symmetric with respect to the structure of the top or front surface portion 16 of the printed circuit board substrate 12 except for the fact that the microstrip line 18 and coaxial feed point 30 components, disposed upon the top or front surface portion 16 of the printed circuit board substrate 12, are not present upon, or have been omitted from, a first lower lateral side portion 50 of the bottom or rear surface portion 36 of the printed circuit board substrate 12 as viewed in FIG. 3 and with respect to the orientation of the substrate 12 as shown in FIG. 1. However, in accordance with the specifically developed structure uniquely characteristic of the new and improved balun component or structural subassembly 10 constructed in accordance with the principles and teachings of the present invention, it is seen that, in a manner similar to the top or front surface portion 16 of the printed circuit board substrate 12, the bottom or rear surface portion 36 of the printed circuit board substrate 12 comprises a second anti-symmetric ground plane 52 which is copper-plated upon the bottom or rear surface portion 38 of the printed circuit board substrate 12 and which is disposed at a radially offset position with respect to the longitudinal axis 14 of the printed circuit board substrate 12 so as to effectively be disposed upon a second upper lateral side portion 54 of the bottom or rear surface portion 38 of the printed circuit board substrate 12 as considered with respect to the longitudinal axis 14 when the printed circuit board substrate 12 is disposed in a fixed position as would be the case when viewed in FIGS. 1 and 3.

As a result of the aforenoted presence or provision of the RF short circuit point 34, and its connection to the bottom or lower surface portion 38 of the printed circuit board substrate 12, or more particularly, as a result of the RF short circuit point or hole 34 electrically connecting the first top surface anti-symmetric ground plane 24 to the second bottom surface anti-symmetric ground plane 52, the aforenoted first portions of the incoming signals are also now able to be transmitted or conducted by means of the RF short circuit point or hole 34 toward and along the second anti-symmetric ground plane 52 which, in turn, is electrically connected to a second tapered transformer 56. In this manner, those portions of the incoming signals are likewise able to be transformed from signals having an impedance value of 50 ohms to signals having an impedance value of 120 ohms so as to likewise facilitate the impedance matching with the spiral circuit component 40 of the antenna radome assembly 42, the structure of which will be discussed in greater detail in connection with FIGS. 4 and 5. As was the case with the first tapered transformer 38, it is to be noted that the transformation of the first signal portion being conducted or transmitted along the second tapered transformer 56 occurs as a result of the second tapered transformer 56 likewise having a uniquely curved, arcuate, or tapered configuration, as disclosed within FIGS. 2 and 3, which extends in the longitudinal axial direction from its integral connection with the second anti-symmetric ground plane 52 toward the opposite end edge portion 44 of the printed circuit board subtrate 12 so as to terminate in a balun tip antenna connection line or terminal wire 58 which likewise extends a predetermined distance beyond the opposite end edge portion 44 of the printed circuit board substrate 12.

It is noted still further that the upper edge portion 60 of the second tapered transformer 56, as disclosed or viewed in FIG. 2, or the lower edge portion 60 of the second tapered transformer 56, as disclosed or viewed in FIG. 3, is respectively disposed above or beneath the longitudinal axis 14 so as to be effectively disposed upon the first lower lateral side portion 50 of the bottom or rear surface portion 38 of the printed circuit board substrate 12. In a manner similar to the disposition of the upper edge portion 48 of the first tapered transformer 38, as viewed or disclosed in FIG. 1, with respect to its position above the longitudinal axis 14 so as to be effectively disposed upon the first upper lateral side portion 22 of the top or front surface portion 16 of the printed circuit board substrate 12, the disposition of the edge portion 60 of the second tapered transformer 56 upon the first lower lateral side portion 50 of the bottom or rear surface portion 38 of the printed circuit board substrate 12 is critically important in that there is in effect defined an overlap of the two edge portions 48 and 60 of such tapered transformers 38 and 56 whereby the aforenoted resultant impedance values of 120 ohms for antenna impedance matching are able to in fact be achieved. It is critically important to appreciate still further the fact that all of the structural components respectively defining or disposed upon each one of the upper or front and lower or rear surface portions 16 and 38 of the printed circuit board substrate 12 are respectively asymmetrically located with respect to the longitudinal axis 14 of the balun component or structural subassembly 10 and are anti-symmetric with respect to each other from an overall viewpoint of the balun component or structural sub-assembly 10.

Figure 5:
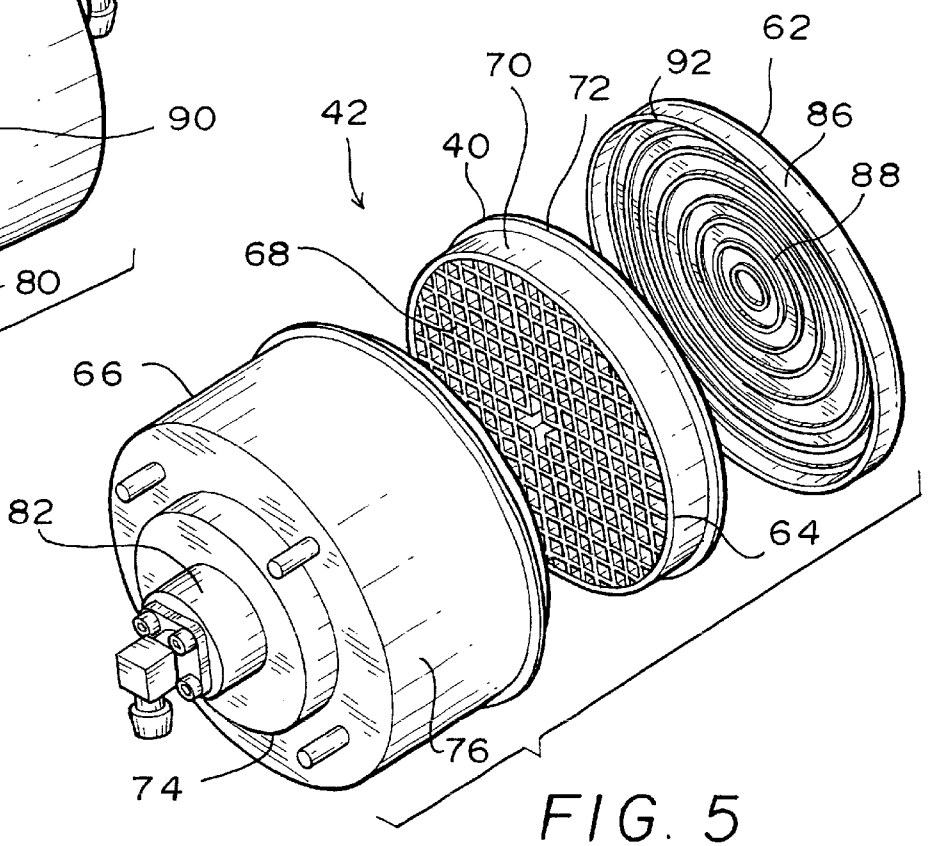
FIG. 5 is an exploded, rear perspective view of the antenna assembly illustrated in FIG. 4 showing, particularly in connection with FIG. 4, the mounting of the new and improved balun component or structural subassembly, constructed in accordance with the principles and teachings of the present invention, for use in connection with antenna assemblies for achieving well-behaved and unsquinted amplitude and phase patterns regardless or independent of polarization in order to reduce angle of arrival (AOA) errors.
Figure 4:
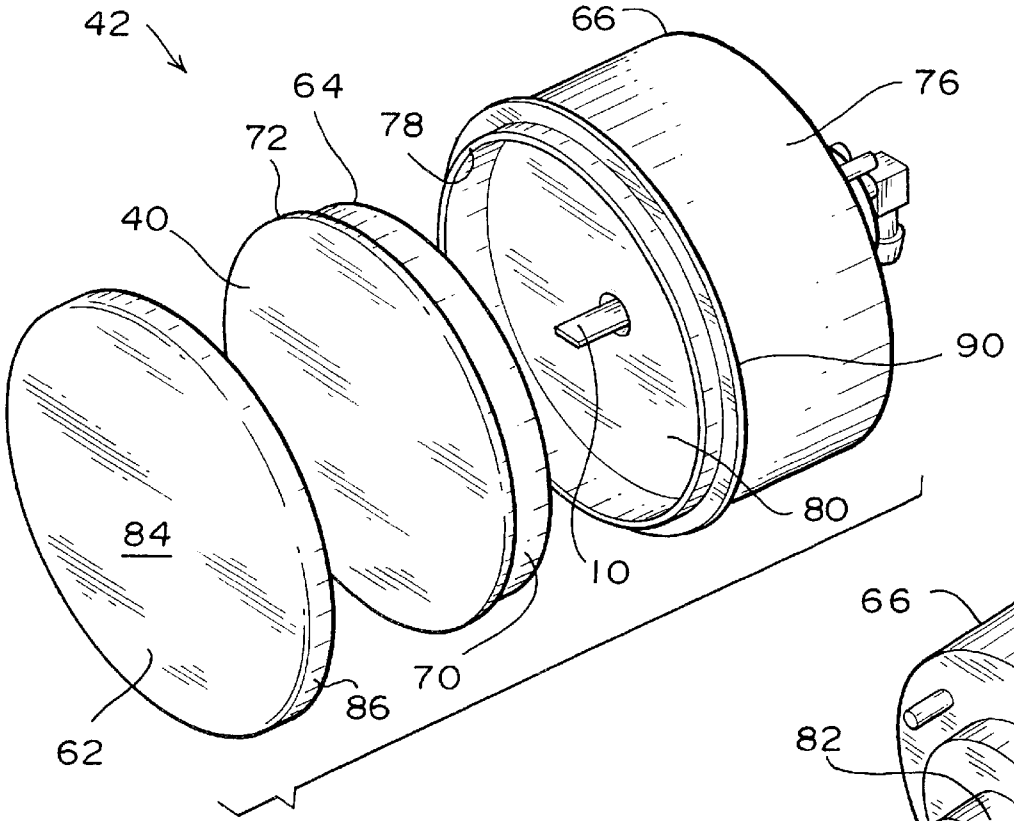
FIG. 4 is an exploded, front perspective view of an antenna assembly in connection with which the new and improved balun component or structural subassembly, constructed in accordance with the principles and teachings of the present invention, is to be utilized in order to in fact achieve well-behaved and unsquinted amplitude and phase patterns regardless or independent of polarization in order to reduce angle of arrival (AOA) errors.

The aforenoted asymmetric and anti-symmetric characteristics of the balun component or structural subassembly 10 enables or facilitates improved operative cooperation with the antenna radome assembly 42 as disclosed more in detail in FIGS. 4 and 5. More particularly, an antenna radome assembly, similar to the antenna radome assembly 42 disclosed within FIGS. 4 and 5, is disclosed, for example, in more detail within U.S. patent application Ser. No. 09/759,851 which was filed in the name of Jeffrey T. Butler on Jan. 12, 2001 and is entitled LOW PROFILE ANTENNA RADOME ELEMENT WITH RIB REINFORCEMENTS, the disclosure of which is incorporated herein by reference. Briefly, however, for the purposes of the present patent application and the invention embodied herein, it is seen that the antenna radome assembly 42, in connection with which the new and improved the balun component or structural subassembly 10 of the present invention is to be operatively used, comprises an antenna radome element or component 62, the spiral circuit element or member 40 upon which a pair of spiral circuits, arrays, or arrangements are disposed, a spiral circuit support member or component 64 which together with the spiral circuit element or member 40 comprises a spiral circuit support assembly, and a housing member or component 66.

The spiral circuit element or member 40 comprises a printed circuit board assembly which has the configuration of a substantially flat disk, which may be fabricated from a suitable dielectric material, similar to the material from which the balun printed circuit board substrate 12 is fabricated, such as, for example, polytetrafluoroethylene or TEFLON®, and which has a pair of copper circuits, not shown, provided thereon as is conventional. The spiral circuit element or member 40 is adapted to be mounted upon the front face of the spiral circuit support member or component 64 and is preferably bonded thereto by means of a suitable adhesive so as to form the aforenoted integral spiral circuit support assembly. The spiral circuit support member or component 64 is further noted as comprising a honeycomb core structure 68, as best seen in FIG. 5, and an annular reinforcing peripheral wall 70 is integrally secured around the honeycomb core structure 68. In order to facilitate the mounting and bonding of the spiral circuit element or member 40 upon the front face of the spiral circuit support member or component 64, the front end of the spiral circuit support member or component 64, and more particularly, the front edge portion of the annular reinforcing peripheral wall 70, is provided with a radially outwardly extending or projecting flange portion 72 which, in addition to the front face or surface of the honeycomb core structure 68 of the spiral circuit support member or component 64, effectively defines a seat upon which the spiral circuit element or member 40 is able to be mounted and bonded. As may best be seen from FIG. 5, the housing member or component 66 comprises a substantially hollow structure which has a substantially cup-shaped configuration as defined by means of an open forward end, a base or rear end wall member 74, and a peripheral side wall 76.

It is seen that the inner diametrical dimension of the housing side wall 76 is just slightly larger than the outer diametrical dimension of the annular peripheral wall 70 of the spiral circuit support member or component 64, and in this manner, the annular peripheral wall portion 70, and the operatively associated honeycomb core structure 68, of the spiral circuit support member or component 64 is adapted, and is therefore able, to be mounted and seated internally within the forward open end of the housing 66. In conjunction with the internal disposition of the honeycomb core structure 68 and the annular peripheral wall portion 70 of the spiral circuit support member or component 64 within the forward open end of the housing 66, the rear side of the radially outwardly projecting flange portion 72 of the annular peripheral wall portion 70 of the spiral circuit support member or component 64 is seated upon the forward annular edge portion 78 of the side wall 76 of the housing 66 so as to ensure the proper and secure disposition and mounting of the spiral circuit support assembly upon or within the housing 66. Continuing further, a pair of frequency absorber foam members, only one of which is shown at 80, are disposed within the housing 66, and it is seen that the balun component or structural subassembly 10 is disposed coaxially within the housing 66.

More particularly, the rear end portion of the balun component or structural subassembly 10 is suitably secured within an axially protruding, rearwardly disposed stepped portion 82 of the housing 66, and the balun component or structural subassembly 10 is adapted to pass coaxially through the frequency absorber foam members 80 such that the forward end of the balun component or structural subassembly 10 projects coaxially outwardly from the front surface of the forward one of the pair of frequency absorber foam members 80. In addition, it is also to be appreciated that when the integral spiral circuit support assembly, comprising the spiral circuit element or member 40 and the spiral circuit support member or component 64, is mounted or assembled within the forward open end of the housing 66, the forward end of the balun component or structural subassembly 10 will likewise be disposed coaxially within the honeycomb core structure 68 of the spiral circuit support member or component 64. It is also to be appreciated that the axial thickness or depth dimension of the pair of frequency absorber foam members 80 is less than that of the housing 66 such that the front surface of the forward one of the pair of frequency absorber foam members 80 is effectively disposed in a recessed mode set axially backwardly from the forward annular edge portion 78 of the side wall 76 of the housing 66. In this manner, the integral spiral circuit support assembly, comprising the spiral circuit element or member 40 and the spiral circuit support member or component 64, is able to be completely and properly mounted or accommodated within the housing 66 with the radially outwardly projecting flange portion 72 of the annular peripheral wall portion 70 of the spiral circuit support member or component 64 being seated upon the forward annular edge portion 78 of the side wall 76 of the housing 66 as has been noted hereinbefore.

With the various components being so mounted or assembled, it can be further appreciated that the terminal wires 46,58 of the balun component or structural subassembly 10 are adapted to project axially through the spiral circuit element or member 40 so as to be able to be electrically connected to the forward face of the spiral circuit element or member 40 by any suitable means, such as, for example, solder connections or the like, not shown, for electrical connection to the pair of spiral circuits formed upon the spiral circuit element or member 40. As has been noted within the previously referenced, previously filed U.S. patent application Ser. No. 09/759,851 entitled LOW PROFILE ANTENNA. RADOME ELEMENT WITH RIB REINFORCEMENTS, the terminal wires 46,58 of the balun component or structural subassembly 10 must also be accommodated within the antenna radome element or component 62. Accordingly, it is further seen that the antenna radome element or component 62 has a substantially cup-shaped configuration as defined by means of a forwardly disposed wall member 84 from which a rearwardly disposed annular or peripheral side wall member 86 projects, and a plurality of concentrically arranged reinforcing rib members 88 are provided upon the interior surface of the wall member 84. The centralmost one of the concentrically arranged rib members 88 defines a pocket or recess within which the terminal wires 46,58 of the balun component or structural subassembly 10 are in fact accommodated.

It is further noted that the housing 66 is also provided with a radially outwardly projecting annular flange portion 90 at an axial position which is adjacent to, but axially set back from, the forward annular edge portion 78 of the side wall 76 of the housing 66, and in this manner, when the antenna radome element 62 is bonded to and upon the spiral circuit element or member 40, and when the spiral circuit support assembly, comprising the spiral circuit element or member 40 and the spiral circuit support member or component 64, is in turn mounted within housing 66, the annular or peripheral edge portion 92 of the antenna radome element side wall 86 will be seated upon the annular flange portion or member 90 of the housing side wall 76. This effectively completes the assembly of the antenna radome assembly 42 and clearly illustrates the operative cooperation defined between the new and improved balun component or structural subassembly 10 constructed in accordance with the principles and teachings of the present invention and the antenna radome assembly 42.

Figure 6:
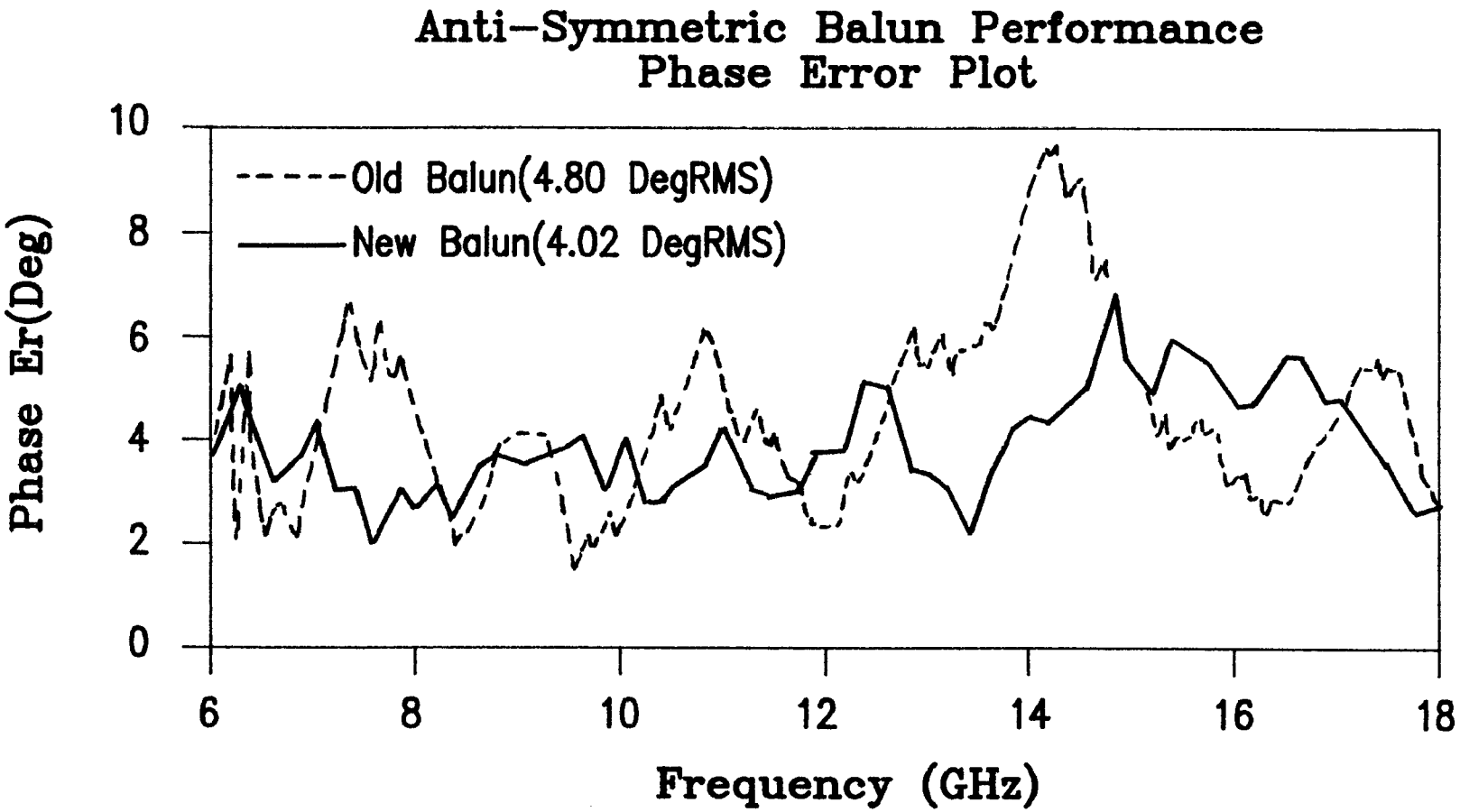
FIG. 6 is a graphical plot of phase interferometer error as a function of frequency illustrating the enhanced performance achieved by means of the new and improved balun component or structural subassembly constructed in accordance with the principles and teachings of the present invention as compared to a PRIOR ART balun component or structural assembly.
Figure 7:
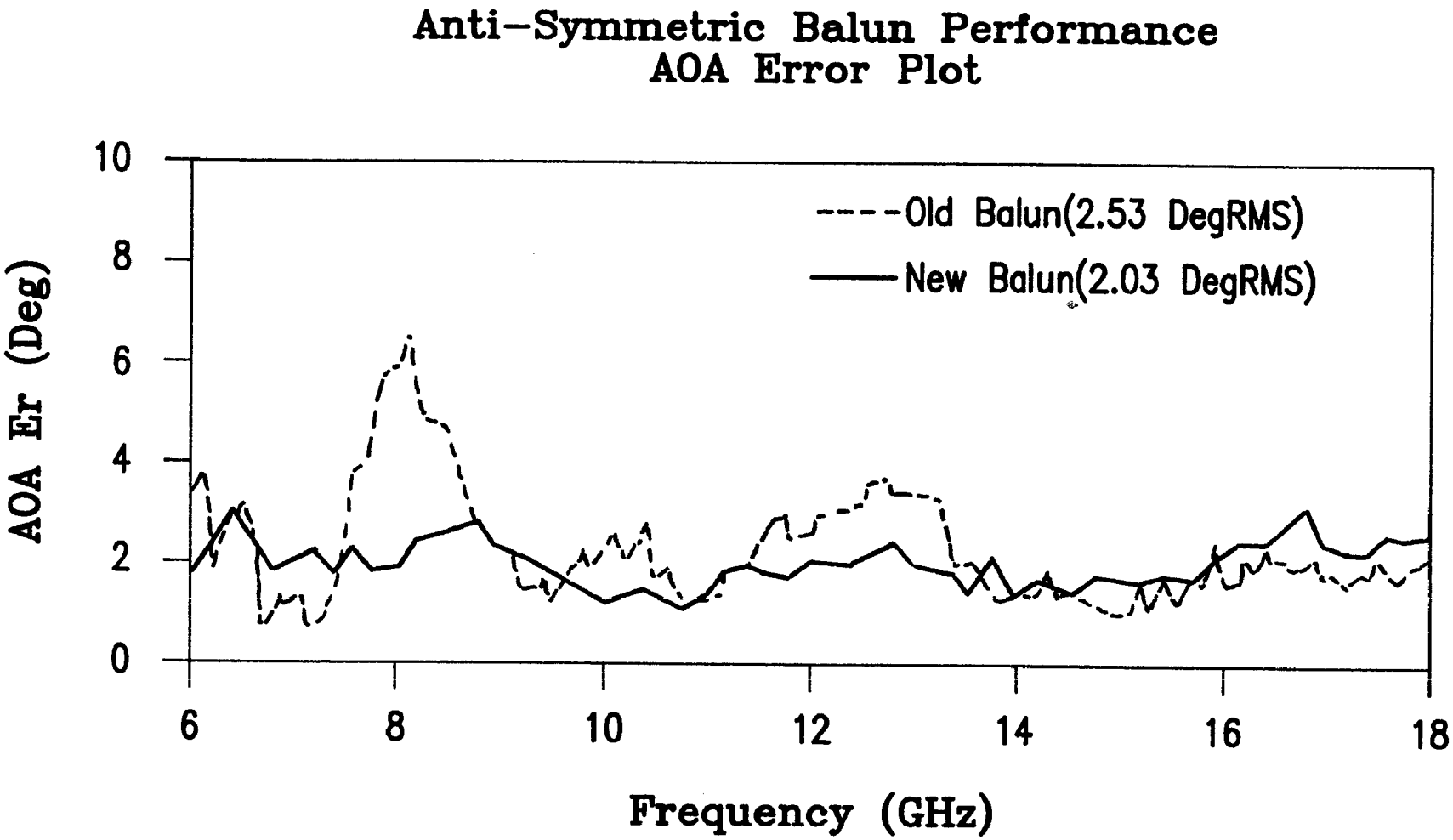
FIG. 7 is a graphical plot of angle of arrival (AOA) error as a function of frequency illustrating the enhanced performance achieved by means of the new and improved balun component or structural subassembly constructed in accordance with the principles and teachings of the present invention as compared to a PRIOR ART balun component or structural assembly.

Thus, it may be seen that in accordance with the principles and teachings of the present invention, there has been provided a new and improved balun component or structural subassembly 10 which achieves various operational parameters or characteristics which have not heretofore been able to be achieved or accomplished by means of conventional or PRIOR ART balun component or structural subassemblies. More particularly, the asymmetric structure of each side of the balun component or structural subassembly 10, and the anti-symmetric structure of the overall or two-sided balun component or structural subassembly 10, provides enhanced phase error and angle of arrival (AOA) error characteristics, in degrees and as functions of frequency, as graphically illustrated in FIGS. 6 and 7. The phase error data, for example, is derived from well-known phase interferometer amplitude comparison direction finding techniques employed in connection with two antenna assemblies or installations which are spaced a predetermined distance apart, and as seen from FIG. 6, a conventionally used balun exhibited an average phase error of 4.80 degrees RMS (root mean square) over the frequency range of 6–18 GHz, whereas the new and improved balun component or structural subassembly 10, constructed in accordance with the principles and teachings of the present invention, exhibited an average phase error of only 4.02 degrees RMS (root mean square). In a similar manner, the angle of arrival (AOA) error data, for example, is derived from well-known measurements involving predetermined azimuth polarization angular orientations of the antenna assemblies or installations, and as seen in FIG. 7, a conventionally used balun exhibited an average angle of arrival (AOA) error of 2.53 degrees RMS (root mean square) over the frequency range of 6–18 GHz, whereas the new and improved balun component or structural subassembly 10, constructed in accordance with the principles and teachings of the present invention, exhibited an average angle of arival (AOA) error of only 2.03 degrees RMS (root mean square).

Figure 8:
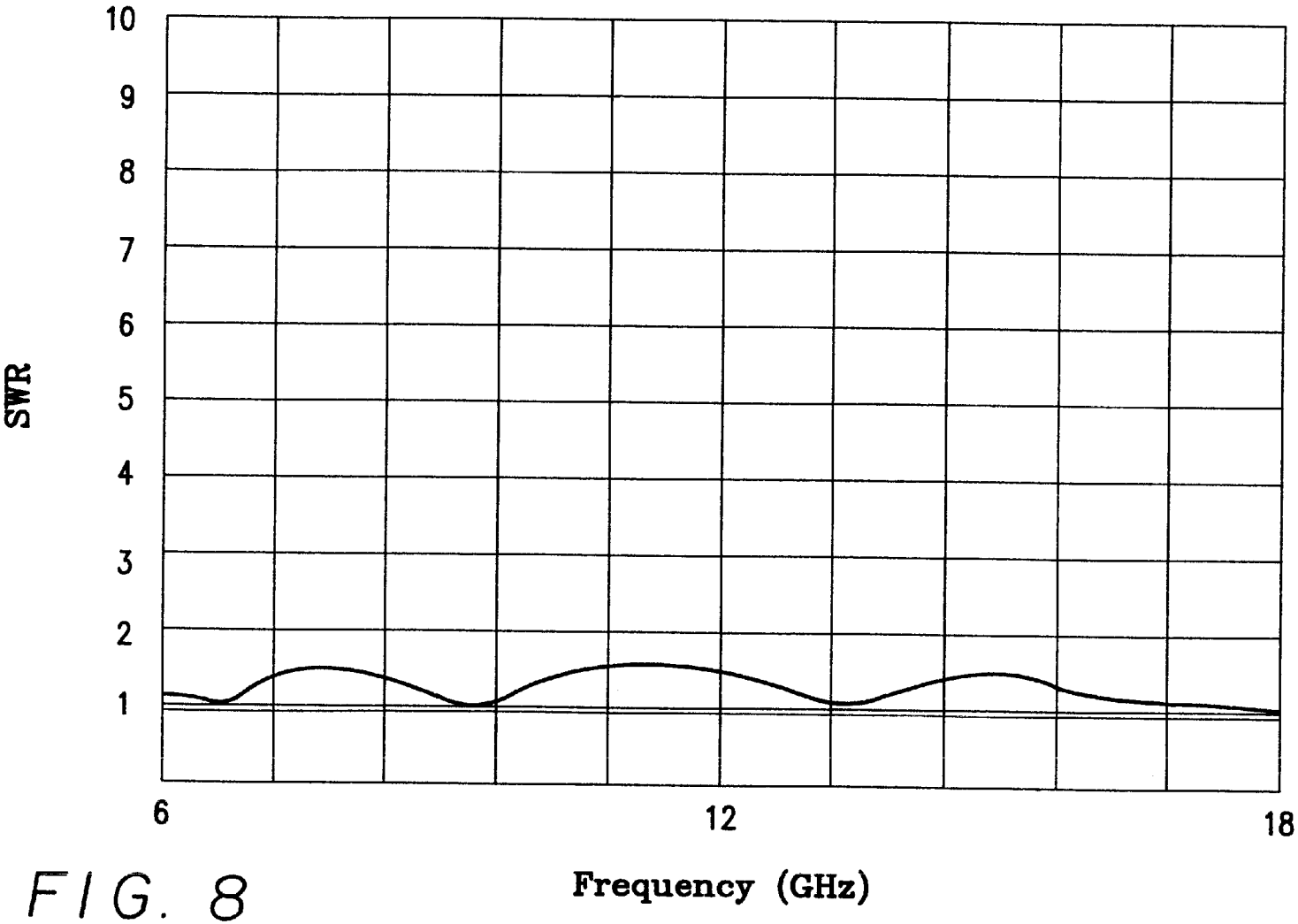
FIG. 8 is a graphical plot of standing wave ratio (SWR) as a function of frequency illustrating the enhanced efficiency achieved by means of the new and improved balun component or structural subassembly constructed in accordance with the principles and teachings of the present invention.

With reference now being directed to FIG. 8, wherein the standing wave ratio (SWR) characteristics of the balun component or structural subassembly 10 are plotted as a function of frequency, it is further seen and appreciated that the new and improved balun component or structural subassembly 10, constructed in accordance with the principles and teachings of the present invention, exhibits maximum standing wave ratio (SWR) values of approximately 1.5:1, whereas, as is known in the art, a standing wave ratio (SWR) of 1:1 is considered perfect or ideal. This data is indicative of the efficiency of the balun component or structural subassembly 10 as implemented by means of, for example, its impedance matching characteristics with respect to the antenna radome assembly 42.

It is lastly noted that as a result of the particular structure of the new and improved balun component or structural subassembly 10, constructed in accordance with the principles and teachings of the present invention, the new and improved balun component or structural subassembly 10 of the present invention also exhibits broad frequency bandwidth operating capabilities. These broad frequency bandwidth operating capabilities are derived from the fabrication or implementation of the pair of first and second tapered transformers 38 and 56 and the respective use or disposition of the same at their relatively anti-symmetric locations upon the oppositely disposed top or front, and bottom or rear, surfaces portions or regions 16 and 36 of the balun component or structural subassembly 10 whereby, as has been noted hereinbefore, such tapered transformers 38,56 transform the impedance values of the incoming or transmitted signals from 50 ohms to 120 ohms. In addition, it is also noted that in conjunction with such tapered transformers 38,56, the presence or provision of the air gap 43 as defined between the microstrip line 18 and the first anti-symmetric ground plane 24 upon the top or front surface 16 of the balun component or structural subassembly 10 likewise serves to provide, establish, or affect, in a well-known manner, advantageous inductance, capacitance, and impedance values or parameters which together with the tapered transformers 38,56 generate or facilitate the broad frequency bandwidth operating capabilities of the balun component or structural subassembly 10 of the present invention.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A balun component structural subassembly for use in connection with an antenna radome assembly, comprising:

a printed circuit board substrate having a longitudinal axis, and a pair of opposite side surfaces;

a coaxial feed point electrically connected to a first one of said pair of opposite side surfaces of said printed circuit board substrate for feeding incoming signals onto said printed circuit board substrate;

a first ground plane disposed upon said first one of said pair of opposite side surfaces of said printed circuit board substrate and electrically connected to said coaxial feed point;

a first transformer disposed upon said first one of said pair of opposite side surfaces of said printed circuit board substrate, electrically connected to said first ground plane of said printed circuit board substrate, and extending in a predetermined direction so as to terminate in a first balun tip antenna connection line;

a second ground plane disposed upon a second one of said pair of opposite side surfaces of said printed circuit board substrate and electrically connected to said first ground plane disposed upon said first one of said pair of opposite side surfaces of said printed circuit board substrate;

a second transformer disposed upon said second one of said pair of opposite side surfaces of said printed circuit board substrate, electrically connected to said second ground plane of said printed circuit board substrate, and extending in said predetermined direction so as to terminate in a second balun tip antenna connection line;

said first ground plane and said first transformer disposed upon said first one of said pair of opposite side surfaces of said printed circuit board substrate being disposed in an anti-symmetric manner with respect to said second ground plane and said second transformer disposed upon said second one of said pair of opposite sides of said printed circuit board substrate and in a 180° out-of-phase manner such that the entire balun component structural subassembly exhibits diametrical symmetry with respect to and around said longitudinal axis of said printed circuit board substrate such that the antenna radome assembly can achieve well-behaved and unsquinted amplitude and phase patterns regardless and independent of polarization in order to reduce angle of arrival (AOA) errors to the antenna radome assembly.

2. The balun component structural subassembly as set forth in claim 1, further comprising:

a microstrip line disposed upon said first one of said pair of opposite side surfaces of said printed circuit board substrate and interposed between said coaxial feed point and said first ground plane for electrically connecting said coaxial feed point to said first ground plane.

3. The balun component structural subassembly as set forth in claim 2, wherein:

said microstrip line is disposed upon a first lateral side portion of said first one of said pair of opposite side surfaces of said printed circuit board substrate as defined with respect to said longitudinal axis of said printed circuit board substrate; and said first ground plane is disposed upon a second lateral side portion of said first one of said pair of opposite side surfaces of said printed circuit board substrate as defined with respect to said longitudinal axis of said printed circuit board substrate.

4. The balun component structural subassembly as set forth in claim 2, wherein:

said first and second transformers respectively disposed upon said first and second oppositely disposed side surfaces of said printed circuit board substrate comprise tapered transformers having arcuately tapered edge portions for transforming the impedance values of said incoming signals such that resultant signals transmitted along said first and second tapered transformers have impedance values which facilitate impedance matching with operatively associated antenna radome assemblies and which enable operating parameters comprising broad bandwidth frequencies.

5. The balun component structural subassembly as set forth in claim 4, wherein:

an air gap is defined between said microstrip line and said first ground plane disposed upon said first one of said pair of opposite side surfaces of said printed circuit board substrate for operative cooperation with said first ground plane and said first tapered transformer so as to define inductance, capacitance, and impedance values for enabling operation at broad bandwidth frequencies.

6. The balun component structural subassembly as set forth in claim 1, wherein:

said first and second transformers respectively disposed upon said first and second oppositely disposed side surfaces of said printed circuit board substrate comprise tapered transformers having arcuately tapered edge portions for transforming the impedance values of said incoming signals such that resultant signals transmitted along said first and second tapered transformers have impedance values which facilitate impedance matching with operatively associated antenna radome assemblies and which enable operating parameters comprising broad bandwidth frequencies.

7. The balun component structural subassembly as set forth in claim 1, wherein:

said first and second transformers respectively disposed upon said first and second oppositely disposed side surfaces of said printed circuit board substrate comprise tapered transformers having arcuately tapered edge portions for transforming the impedance values of said incoming signals such that resultant signals transmitted along said first and second tapered transformers have impedance values which facilitate impedance matching with operatively associated antenna radome assemblies.

8. The balun component structural subassembly as set forth in claim 1, wherein:

said first and second transformers respectively disposed upon said first and second oppositely disposed side surfaces of said printed circuit board substrate comprise tapered transformers having arcuately tapered edge portions for transforming the impedance values of said incoming signals from 50 ohms to resultant signals transmitted along said first and second tapered transformers which have impedance values of 120 ohms so as to facilitate impedance matching with operatively associated antenna radome assemblies.

9. The balun component structural subassembly as set forth in claim 1, wherein:

said first and second transformers are respectively disposed upon said second lateral side portions of said first and second ones of said pair of oppositely disposed side surfaces of said printed circuit board substrate as defined with respect to said longitudinal axis of said printed circuit board substrate but have edge portions which are respectively disposed upon said first lateral side portions of said first and second ones of said pair of oppositely disposed surfaces of said printed circuit board substrate as defined with respect to said longitudinal axis of said printed circuit board substrate so as to effectively over-lap each other along said longitudinal axis of said printed circuit board substrate so as to ensure the definition of a predetermined impedance value and thereby facilitate impedance matching with operatively associated antenna radome assemblies.

10. The balun component structural subassembly as set forth in claim 1, wherein:

when said printed circuit board substrate is disposed in a predetermined orientation, said first ground plane and said first transformer are respectively disposed upon a first lateral side portion of said first one of said pair of oppositely disposed side surfaces of said printed circuit board substrate as considered with respect to said longitudinal axis of said printed circuit board substrate, and said second ground plane and said second transformer are respectively disposed upon a second lateral side portion of said second one of said pair of oppositely disposed side surfaces of said printed circuit board substrate as considered with respect to said longitudinal axis of said printed circuit board substrate.

11. An antenna radome assembly, comprising:

an antenna radome element;

a spiral circuit element upon which said antenna radome element is mounted;

a housing upon which said spiral circuit element is mounted; and a balun component structural subassembly mounted within said housing and operatively connected to said spiral circuit element;

wherein said balun component structural subassembly comprises a printed circuit board substrate having a longitudinal axis, and a pair of opposite side surfaces; a coaxial feed point electrically connected to a first one of said pair of opposite side surfaces for feeding incoming signals onto said printed circuit board substrate; a first ground plane disposed upon said first one of said pair of opposite side surfaces and electrically connected to said coaxial feed point; a first transformer disposed upon said first one of said pair of opposite side surfaces and electrically connected to said first ground plane; a second ground plane disposed upon a second one of said pair of opposite side surfaces and electrically connected to said first ground plane disposed upon said first one of said pair of opposite side surfaces; and a second transformer disposed upon said second one of said pair of opposite side surfaces and electrically connected to said second ground plane; said first ground plane and said first transformer disposed upon said first one of said pair of opposite side surfaces of said printed circuit board substrate being disposed in an anti-symmetric manner with respect to said second ground plane and said second transformer disposed upon said second one of said pair of opposite sides of said printed circuit board substrate in a 180° out-of-phase manner such that the entire balun component structural subassembly exhibits diametrical symmetry with respect to said longitudinal axis of said printed circuit board substrate such that said antenna radome assembly can achieve well-behaved and unsquinted amplitude and phase patterns regardless and independent of polarization in order to reduce angle of arrival (AOA) errors to said antenna radome element.

12. The antenna radome assembly as set forth in claim 11, wherein:

when said printed circuit board substrate is disposed in a predetermined orientation, said first ground plane and said first transformer are respectively disposed upon a first lateral side portion of said first one of said pair of oppositely disposed side surfaces of said printed circuit board substrate as considered with respect to said longitudinal axis of said printed circuit board substrate, and said second ground plane and said second transformer are respectively disposed upon a second lateral side portion of said second one of said pair of oppositely disposed side surfaces of said printed circuit board substrate as considered with respect to said longitudinal axis of said printed circuit board substrate.

13. The antenna radome assembly as set forth in claim 11, wherein:

said first and second transformers respectively disposed upon said first and second oppositely disposed side surfaces of said printed circuit board substrate comprise tapered transformers having arcuately tapered edge portions for transforming the impedance values of said incoming signals such that resultant signals transmitted along said first and second tapered transformers have impedance values which facilitate impedance matching with said spiral circuit element of said antenna radome assembly.

14. The antenna radome assembly as set forth in claim 11, wherein:

said first and second transformers respectively disposed upon said first and second oppositely disposed side surfaces of said printed circuit board substrate comprise tapered transformers having arcuately tapered edge portions for transforming the impedance values of said incoming signals from 50 ohms to resultant signals transmitted along said first and second tapered transformers which have impedance values of 120 ohms so as to facilitate impedance matching with said spiral circuit element of said antenna radome assembly.

15. The antenna radome assembly as set forth in claim 11, wherein:

said first and second transformers respectively disposed upon said first and second oppositely disposed side surfaces of said printed circuit board substrate comprise tapered transformers having arcuately tapered edge portions for transforming the impedance values of said incoming signals such that resultant signals transmitted along said first and second tapered transformers have impedance values which facilitate impedance matching with said spiral circuit element of said antenna radome assembly and which enable operating parameters comprising broad bandwidth frequencies.

16. The antenna radome assembly as set forth in claim 11, wherein:

said first and second transformers are respectively disposed upon said second lateral side portions of said first and second ones of said pair of oppositely disposed side surfaces of said printed circuit board substrate as defined with respect to said longitudinal axis of said printed circuit board substrate but have edge portions which are respectively disposed upon said first lateral side portions of said first and second ones of said pair of oppositely disposed surfaces of said printed circuit board substrate as defined with respect to said longitudinal axis of said printed circuit board substrate so as to effectively overlap each other along said longitudinal axis of said printed circuit board substrate so as to ensure the definition of a predetermined impedance value and thereby facilitate impedance matching with said spiral circuit element of said antenna radome assembly.

17. The antenna radome assembly as set forth in claim 11, further comprising:

a microstrip line disposed upon said first one of said pair of opposite side surfaces of said printed circuit board substrate and interposed between said coaxial feed point and said first ground plane for electrically connecting said coaxial feed point to said first ground plane.

18. The antenna radome assembly as set forth in claim 17, wherein:

said microstrip line is disposed upon a first lateral side portion of said first one of said pair of opposite side surfaces of said printed circuit board substrate as defined with respect to said longitudinal axis of said printed circuit board substrate; and said first ground plane is disposed upon a second lateral side portion of said first one of said pair of opposite side surfaces of said printed circuit board substrate as defined with respect to said longitudinal axis of said printed circuit board substrate.

19. The antenna radome assembly as set forth in claim 17, wherein:

said first and second transformers respectively disposed upon said first and second oppositely disposed side surfaces of said printed circuit board substrate comprise tapered transformers having arcuately tapered edge portions for transforming the impedance values of said incoming signals such that resultant signals transmitted along said first and second tapered transformers have impedance values which facilitate impedance matching with said spiral circuit element of said antenna radome assembly and which enable operating parameters comprising broad bandwidth frequencies.

20. The antenna radome assembly as set forth in claim 19, wherein:

an air gap is defined between said microstrip line and said first ground plane disposed upon said first one of said pair of opposite side surfaces of said printed circuit board substrate for operative cooperation with said first ground plane and said first tapered transformer so as to define inductance, capacitance, and impedance values for enabling operation at broad bandwidth frequencies.

* * * * *